US009774972B2

(12) United States Patent
Ilkorur et al.

(10) Patent No.: US 9,774,972 B2
(45) Date of Patent: Sep. 26, 2017

(54) LOUDSPEAKER

(71) Applicant: PSS BELGIUM N.V., Dendermonde (BE)

(72) Inventors: Onur Ilkorur, Ghent (BE); David Corynen, Brakel (BE); Edgard Diaz Valencia, Willebroek (BE)

(73) Assignee: PSS Belgium, N.V., Dendermonde (BE)

( * ) Notice: Subject to any disclaimer, the term of this patent is extended or adjusted under 35 U.S.C. 154(b) by 0 days.

(21) Appl. No.: 15/024,884

(22) PCT Filed: Sep. 26, 2014

(86) PCT No.: PCT/EP2014/070647

§ 371 (c)(1),
(2) Date: Mar. 25, 2016

(87) PCT Pub. No.: WO2015/044368

PCT Pub. Date: Apr. 2, 2015

(65) Prior Publication Data

US 2016/0249148 A1 Aug. 25, 2016

(30) Foreign Application Priority Data

Sep. 27, 2013 (GB) ..... 1317193.9

(51) Int. Cl.
*H04R 1/00* (2006.01)
*H04R 31/00* (2006.01)
(Continued)

(52) U.S. Cl.
CPC ..... *H04R 31/006* (2013.01); *H04R 7/12* (2013.01); *H04R 7/18* (2013.01); *H04R 9/025* (2013.01);
(Continued)

(58) Field of Classification Search
CPC ..... H04R 9/043; H04R 2307/025
See application file for complete search history.

(56) References Cited

U.S. PATENT DOCUMENTS 3,961,378 A * 6/1976 White ..... H04R 31/003 181/167
4,118,605 A * 10/1978 Kobayashi ..... H04R 9/045 381/407
(Continued)

FOREIGN PATENT DOCUMENTS

EP 0685981 A2 12/1995
EP 2028876 A1 2/2009
(Continued)

OTHER PUBLICATIONS

UKIPO, Search Report for United Kingdom Patent Application No. GB1317193.9 dated Mar. 20, 2014.
(Continued)

*Primary Examiner* — Curtis Kuntz
*Assistant Examiner* — Ryan Robinson
(74) *Attorney, Agent, or Firm* — NK Patent Law, PLLC

(57) ABSTRACT

The present invention relates to a loudspeaker 1 including a cone 20 having a central aperture with a cone collar 28 upstanding from the perimeter of the central aperture 26 of the cone, a spider 30 having a central aperture 36, the spider having a collar 38 upstanding from the perimeter of the central aperture of the spider, and a voice coil former 40. The collar of each of the cone and the spider are concentrically located around an end region of the voice coil former to form an elongate neck region 12. The use of the elongate neck region allows for the cone, spider and voice coil former to be joined more easily therefore forming a more reliable and durable join.

21 Claims, 9 Drawing Sheets

(51) Int. Cl.

| | |
|---|---|
| ***H04R 7/12*** | (2006.01) |
| ***H04R 7/18*** | (2006.01) |
| ***H04R 9/04*** | (2006.01) |
| ***H04R 9/02*** | (2006.01) |
| ***H04R 9/06*** | (2006.01) |

(52) U.S. Cl.
CPC ..... *H04R 9/043* (2013.01); *H04R 9/06* (2013.01); *H04R 2307/025* (2013.01)

(56) References Cited

U.S. PATENT DOCUMENTS

| | | | | |
|---|---|---|---|---|
| 5,288,009 | A * | 2/1994 | Corlay | B23K 1/20 228/102 |
| 5,602,931 | A | 2/1997 | Geisenberger | |
| 5,625,701 | A * | 4/1997 | Scanlan | H04R 7/16 381/403 |
| 5,729,616 | A * | 3/1998 | Geisenberger | H04R 9/043 181/166 |
| 5,835,612 | A | 11/1998 | Fujihira et al. | |
| 6,088,466 | A * | 7/2000 | Proni | H04R 9/02 381/397 |
| 6,501,844 | B2 * | 12/2002 | Proni | H04R 9/045 381/403 |
| 6,613,123 | B2 * | 9/2003 | Corbin | B22F 1/0003 148/24 |
| 7,272,237 | B2 * | 9/2007 | Linn | H04R 9/045 381/396 |
| 7,970,162 | B2 * | 6/2011 | Sumitani | H04R 9/043 381/400 |
| 8,496,086 | B2 * | 7/2013 | Gerkinsmeyer | H04R 7/10 181/169 |
| 8,767,999 | B2 * | 7/2014 | Shin | H04R 7/122 181/171 |
| 2002/0034315 | A1 | 3/2002 | Auerbach et al. | |
| 2004/0188174 | A1 | 9/2004 | Sahyoun | |
| 2006/0088181 | A1 | 4/2006 | Kaiya et al. | |
| 2006/0147081 | A1 | 7/2006 | Mango, III et al. | |

FOREIGN PATENT DOCUMENTS

| | | | |
|---|---|---|---|
| EP | 2220874 | A1 | 5/2009 |
| SU | 522555 | A1 | 7/1976 |
| SU | 888337 | A1 | 12/1981 |

OTHER PUBLICATIONS

EPO, International Search Report and Written Opinion for PCT Patent Application No. PCT/EP2014/070647 dated Dec. 12, 2014.

* cited by examiner

LOUDSPEAKER

The present invention relates to a loudspeaker, in particular pertaining to a configuration of a loudspeaker.

Loudspeakers are used in the creation and modulation of sound. They are used in many situations that require the transmittal of sound, but can also be used to amplify or reduce ambient sounds present an environment by generating sound to match or counter the ambient sound or actively controlling the sound waves in an enclosed environment by reinforcing or absorbing the sound waves.

The components that are required for a loudspeaker to be able to function are well known. The loudspeaker acoustic components are all held within a frame. To function, a loudspeaker needs a moveable cone or diaphragm that induces pressure waves in the surrounding air when the cone is moved. The movement in the cone is produced by an attachment to a voice coil former. The voice coil former is typically a cylinder that has a voice coil (a wire coil) wrapped around a section of the former. The section of the voice coil former with the coil wrapped around it is held in a magnetic field. When an alternating current is passed through the wire a force is generated to move the voice coil former, which is free to move relative to the magnet. This causes the voice coil former to move back and forth in the magnetic field, which in turn causes the cone to vibrate. To ensure the voice coil is retained in the magnetic field when the voice coil is oscillating, the voice coil former is attached to a spider. The spider is usually a flexible disc that suspends the voice coil former in a neutral or equilibrium position when the loudspeaker is not in use, and provides a returning force towards the neutral position when the voice coil is oscillating. To be able to provide the necessary suspension and forces the spider is also attached to the frame of the loudspeaker. The spider also functions to ensure that the only movement of the voice coil former is axial to the length of the voice coil. The cone and the spider are usually attached to the voice coil former by an adhesive (such as glue) and are attached to the frame by a mechanical connection.

The manufacture of loudspeakers can either be by singular construction or by mass production such as on a production line. The joins between the acoustic components need to be of sufficient quality as otherwise, the loudspeaker will fail. Loudspeakers have intricate and delicate parts that need to be connected to each other. For example, the cone is often made of delicate material and needs to be joined to the voice coil to allow the loudspeaker to function. A further example is the spider, which is conventionally located under the cone of the loudspeaker. This also needs to be connected to the voice coil. Without the connection to the voice coil, the spider cannot perform its function. To ensure that the acoustic components are properly connected to each other requires a significant degree of attention to be paid during the construction of the loudspeaker. Joining the acoustic parts is intricate work due to the relative location and fragility of the parts. If care is not taken an acoustic part may be damaged and, should the work to join the parts be too heavy handed or too forceful, the joins will be of bad quality and will not withstand normal use of the loudspeaker. Therefore careful attention is required when joining the parts because the parts are often intricate and difficult to access.

Due to the intricate nature of the parts and the importance of forming good joins between the acoustic parts, stringent quality checks are needed to ensure that the loudspeakers will not fail. The checks and attention needed during construction are costly as they slow production of loudspeakers.

However, without the checks and care taken over the construction, significant numbers of loudspeakers would fail and production would not be viable.

Accordingly, at its most general, a first aspect of the present invention proposes a loudspeaker with the acoustic components drawn into an elongate neck region. This allows easy access to the acoustic components which makes the components easier to fix together. This causes the joins between the acoustic components to be stronger and more durable and therefore the loudspeaker is more capable of withstanding adverse conditions, as the joins between the acoustic parts will be better.

Loudspeakers can be used in active sound control systems such as is in the modulation, amplification or reduction of exhaust and engine noises in automobiles. To achieve active sound control in this situation a loudspeaker is placed in the exhaust system of a vehicle. However, loudspeakers used in active sound control in automobiles often fail. This is because the exhaust systems contain a number of chemicals, for example, gaseous chemicals in exhaust fumes, especially when in use. In addition to the chemicals present, when the automobile is in use, the temperature of the exhaust system is raised. The temperature of the exhaust system increases rapidly as the distance from the engine exhaust outlet is decreased. Both the heat and the chemicals in the exhaust system can cause conventional adhesives to fail either separately or in combination. If the adhesive of a loudspeaker fails, the loudspeaker will no longer function properly as the acoustic components will no longer have a stable connection between them. The failure of the adhesive can be due to breakdown of the adhesive or through being raised above the operating temperature of the adhesive. To reduce likelihood of failure of the adhesive, a loudspeaker used for active sound control is placed as far from the engine as possible. This locates the speaker at the point of the exhaust system with the lowest temperature and most dilute chemicals. However, this means that more power is required to power the speaker as the pressure waves created in the exhaust system by the engine outputting exhaust fumes attenuate as the distance from the engine increases.

To improve a loudspeakers ability to withstand high operating temperatures, it is known to use glues such as epoxy glues or other chemical glues with high curing temperatures instead of conventional adhesives which fail at the high operating temperatures present in a car exhaust system. These glues also withstand the raised chemical levels in automobile exhaust systems better than conventional glues. Such epoxy or chemical glues are expensive and are also difficult to apply. To cure such epoxy and chemical glues, the glues often require baking. For those glues that require baking to cure, if the glue is not baked, when the glue cures naturally they are glue is brittle and cannot withstand the operating forces in the loudspeaker. Therefore, even if the curing process was successful, the operating temperature for such a loudspeaker will be very close to the operating temperatures of such glues. Therefore any speaker built with such glue would operate unreliably.

Other methods of attaching the acoustic components together are also known. For example, a mechanical solution is disclosed in U.S. Pat. No. 5,581,624. This discloses a curled joint between a diaphragm and a voice coil support allowing the loudspeaker components to be joined by purely mechanical means. However, this restricts the materials that can be used for the acoustic components of the loudspeaker as this mechanical solution requires that the mechanical properties of the acoustic components will not change their mechanical properties as the temperature varies. The materials used are also required to be sufficiently robust so as not to release the curled joint due to movement or wearing of the materials.

An alternative method of attaching the loudspeaker acoustic components together is disclosed in U.S. Pat. No. 5,699,439. This discloses using ultrasonic welding to bind the acoustic components together. However, for ultrasonic welding the components need to be in contact with each other to enable them to be welded together. This requires manufacturing tolerances to be kept minimal. This increases the manufacturing costs, and if the components are not in contact when assembled insulation pieces need to be added to the speaker so that all pieces can be bound together. This makes the manufacture process more intricate and difficult. The technique used to join the materials limits the materials that can be used for the acoustic components, as the material must be ultrasonically weldable. If the materials are limited, the loudspeaker may not be able to be made out of the desired material to give each component their optimal functionality.

To use the mechanical solution disclosed in U.S. Pat. No. 5,581,624 or the ultrasonic welding disclosed in U.S. Pat. No. 5,699,439 the manufacturing setup and production line for mass production of loudspeakers must be significantly different from that of conventional mass production using adhesives as different processes are required during the manufacturing process. This makes the processes expensive and requires a manufacturer to change their machinery significantly.

Accordingly, as an alternative or additional second aspect, at its most general, the present invention proposes a loudspeaker with some or all of the main acoustic components being connected by solder. This allows for a mechanical fixing between the acoustic components to be established thereby allowing the loudspeaker to operate at high operating temperatures.

When the acoustic components are drawn into an elongate neck region in accordance with the first aspect of the invention, this makes the loudspeaker particularly suitable for fixing acoustic components together with solder. This is because the elongate neck region provides improved access to suitable locations to join the acoustic components.

According to the first aspect of the invention, there may be provided a loudspeaker a cone having a central aperture with a cone collar upstanding from the perimeter of the central aperture of the cone; a spider having a central aperture, the spider having a collar upstanding from the perimeter of the central aperture of the spider; and a voice coil former, wherein the collar of each of the cone and the spider is concentrically located around an end region of the voice coil former to form an elongate neck region.

The elongate neck region of the cone collar (the collar of the cone), the spider collar (the collar of the spider) and the voice coil former allows easy access to the acoustic components (the voice coil former, the spider and the cone) to improve the ability to join the acoustic components together. This allows the product used to join the acoustic components to be applied to one location at that is accessible from outside of the loudspeaker thereby making the joining process quicker and more efficient. This leads to lower manufacture costs and enables a high quality of join between the acoustic components to be formed, and therefore the join will be more reliable and durable. This is because as less intricate tools and workmanship are required. In addition to this, a risk of damaging other parts of the acoustic components and/or the loudspeaker are reduced thus enabling more control of the joining process as less account needs to be taken of other parts of the loudspeaker as they are less likely to be damaged.

The concentric geometry of the elongate neck region allows the acoustic components to be fitted together without risk of damaging each part. As such, the loudspeaker can be assembled by a machine allowing the loudspeaker to be constructed on a production line thereby allowing mass production. This is also an advantage of the improved access to joinable locations on the acoustic components.

The spider and the cone of the loudspeaker may be mechanically connected to the voice coil former by a solder joint, the solder being configured to maintain a mechanical connection at an operating temperature up to the melting point of the solder.

Using solder to join the acoustic components allows there to be a mechanical connection between the components that will remain intact and not fail at high operating temperatures, such as, for example, the operating temperature of an automobile exhaust system, thus making the loudspeaker more reliable as solder can be used that has a higher melting point than conventional means for holding component of a loudspeaker together. This allows a mechanical joint (i.e. a glue/adhesive free join) to be used for the loudspeaker.

When used in an automobile exhaust system, there is an additional advantage of using solder to join the acoustic components. In active sound control applications in an automobile exhaust system such a loudspeaker with the acoustic components joined by solder may be placed near the engine. This reduces the amount of power needed to drive the loudspeaker thereby reducing the power draw of the active sound control system which in turn improves the fuel efficiency of the automobile and allows the size and weight of the exhaust systems to be reduced.

The use of solder for the material of the joint material also has the advantage that local heating can be applied to the solder to allow it to be applied to the loudspeaker components. This is because solder will melt under local heating of the solder itself thereby reducing the likelihood of detrimentally affecting any loudspeaker component, or the loudspeaker components as a whole. Local heating also allows for precision in application of the solder.

According to the second aspect of the invention, there may be provided a loudspeaker with, the spider, the cone and the voice coil former may each be joined by solder without the loudspeaker having the elongate neck region. This allows a conventional loudspeaker configuration to be used whilst allowing solder to be used to join the components to each other. This produces the benefits of using solder in that the loudspeaker will be able to operate at a higher temperature than loudspeakers joined with conventional means. This will enable the loudspeaker to be placed closer to the engine in a car exhaust system thereby allowing the power consumption of the loudspeaker to be reduced.

The second aspect of the invention may be an alternative to the first aspect of the invention or may be in addition to the first aspect of the invention.

As a further alternative, two of the acoustic components may be concentrically located to form an elongate neck region and the other part may be formed in a conventional manner with each of the spider, the cone and the voice coil former being joined by solder. However, the use of the concentric location of all the acoustic components to form the elongate neck region with the acoustic components being fixed together with the solder is preferable to only using the solder to fix the acoustic components together without an elongate neck region and to only having two of the acoustic components concentrically located to form an elongate neck region. This is because by having the cone, the spider and the voice coil former concentrically located into the elongate neck region allows for simpler application of the solder. This will thereby cause the solder joint between the components to be stronger, more reliable and the number of production steps will be reduced. Further it will be easier to apply the solder to the acoustic components. With such an improved solder joint between the components, the ability of the loudspeaker to operate at high temperatures will be further improved beyond that of having solder joints without loudspeaker having the elongate neck region.

Solder may be melted by local heating treatment to provide a source of molten solder that can be applied to the loudspeaker components. The solder may be applied to the acoustic components to join each acoustic part to one of the other acoustic components. When all the acoustic components are joined in this manner there will be a plurality of solder joints.

Alternatively, there may be a solder joint that mechanically connects the cone to the spider and the voice coil former. Having all the acoustic components connected by a single solder joint has the advantage of only needing to apply solder to the acoustic components in once. This use of a single solder joint reduces the amount of time taken to join the acoustic components thereby reducing production time. Having a single solder joint also allows a solder bath to be used to apply solder to the acoustic components. The use of a solder bath will reduce production time and further enable the loudspeaker to be made on a production line and be mass production system as the need human input reduced or not required.

At least a portion of each of the acoustic components (the voice coil former and/or the spider and/or the cone) may have a surface coating of a material different to that from which the component is made, wherein the surface coating is suitable for solder contact. The coating may be applied to all of the material or to a part of the material. For example, only the collar of the cone may have a surface coating suitable for solder contact and the rest of the cone may not be coated with the surface coating.

At least one of the acoustic components having at least a portion with a surface coating suitable for solder contact allows the designer of the loudspeaker not to be limited as to the materials available to be used for that acoustic components as a non-solderable material could be used. This is beneficial because different material have different properties that affect how the loudspeaker works and reacts. If the designer is not limited to using solderable materials for the acoustic components, the designer has the ability to choose the most appropriate material for the loudspeakers purpose without needing to take account of how the loudspeaker is to be soldered together.

When at least a portion of the cone and/or the spider and/or the voice coil former has a surface coating of a material suitable for solder contact, the surface coating may be metal wire that is stitched to the voice coil former and/or the spider and/or the cone. Alternatively, the metal wire being stitched to an acoustical component may be in addition to the surface coating. The metal wire improves the solderablility of the material by providing a metal surface for the solder to bind to and provides a larger surface area available for solder to contact when attaching to the component being soldered.

The voice coil former and/or the spider and/or the cone may be made of metal. Being made of metal allows the parts to operate at higher temperatures and to withstand exposure exhaust chemicals better than non-metals. This is because, typically, metals are more resistant to chemicals than non-metals and have higher melting points than non-metals. Having metal components allows the loudspeaker to be used in a more adverse environment than when non-metal materials are used.

To improve the connection between an acoustic component and the solder the voice coil former and/or the spider and/or the cone may have a region pre-tinned with solder. This will make the solder joint stronger as the solder will bind to the pre-tinned region better and more easily than to a region of a component that is not pre-tinned.

At least part of the collar of the cone, the collar of the spider and/or the end region of the voice coil former may be treated with flux, the flux being applied when the cone, spider and voice coil former are separate. This has the advantage that it allows solder to flow over the treated part of the surface to from a more even coverage of solder thereby making the solder joint stronger. Using flux allows the solder to flow evenly over a surface. Without the use of flux the solder does not flow evenly over a surface, but instead forms globules or patches on a surface. This reduces the amount of solder that binds to the surface and reduces the strength of the overall joint as instead of one joint being formed, as when solder is used, multiple small joints are formed each of which is not as strong as a single joint due to the reduced area that each joint is bound to. However, various pre-tinning materials exist that reduce or overcome the need for flux to be used. If such a pre-tinning material is used, this could be used instead of flux as such materials produce the similar effects to flux.

The cone may be insert moulded. This has the advantage that the cone and an edge to the cone that connects the cone to a frame of the loudspeaker may be formed of a single piece. Alternatively, or in addition to the cone in a single piece with the edge, if the cone is insert moulded there may be fibres, filaments, or filings of solderable material that are embedded in at least the collar of the cone during the moulding process to improve the ability of the cone to bind to solder.

The cone may be made of Teflon (also known as Polytetrafluoroethylene or PTFE). This has the advantage that Teflon has good electrical properties for use in loudspeakers and good heat properties. Teflon is a good electrical insulator, so when used in for the loudspeaker cone, the cone will not conduct electricity at the levels of current used for loudspeakers. The melting point of Teflon is 327° C. This makes it a suitable material for use in, for example, automobile exhaust systems. Teflon is also non-gluable, i.e. glue or adhesive cannot be used to connect Teflon to another piece of material.

The cone may be made of Teflon and the voice coil former and/or the spider may be made of metal. For the metal components, this has the advantages of the components being metal as described above, and for the cone being made of Teflon, that has the advantages of Teflon as stated above. This combination of metal and Teflon components has the advantage that optimum heat and acoustic qualities of the each component may be produced whilst still allowing the loudspeaker to operate at a high operating temperature.

According to the invention, there may also be provided a method of constructing a loudspeaker, comprising the steps: assembling a cone, a spider and a voice coil former into a concentric geometry by fitting a collar of the cone and a collar of the spider around an end region of the voice coil former to form an elongate neck region, the cone collar being upstanding from the perimeter of a central aperture of the cone and the spider collar being upstanding from the perimeter of a central aperture of the spider.

Assembling the loudspeaker in this way allows the loudspeaker to be assembled by an automated production line and to be mass-produced which reduces both production time and production costs. The time and cost saving is enabled as the number of production steps is decreased as the acoustic components are able to be assembled in fewer steps. In addition to this, the components can be joined in a single step. This further reduces the production time. Such a join will also be stronger and more reliable, so the quality checking can be reduced with reduces the cost of production as the loudspeaker is less likely to fail.

Solder may be used to mechanically connect the voice coil former, the spider and the cone of the loudspeaker, and wherein the solder maintains a mechanical connection at an operating temperature up to the melting point of the solder.

Using solder to join the acoustic components allows the loudspeaker to be produced on a production line that requires minimal adaptation from a production line used for making loudspeakers in a conventional manner, for example, with conventional adhesives. Instead of applying adhesive to the loudspeaker, solder, which is not known to be used to join acoustic components together, can be applied in place of the adhesive in the production line.

When solder is used to the form a mechanical joint between the acoustic components, the method of manufacturing the loudspeaker may further include dipping the elongate neck region in a solder bath of molten solder; removing the elongate neck region from the solder bath of molten solder, wherein solder adhering to the elongate neck region is set by allowing the solder to cure, thereby forming the solder joint between the cone, spider and voice coil former as a mechanical connection.

As the loudspeaker is dipped into the solder when the solder is in a molten form, the solder is able to penetrate into gaps between the voice coil former, the collar of the spider and/or the collar of the cone that exist due to manufacturing tolerances by capillary action. This allows for a stronger bond with the solder than if the capillary action did not occur and therefore strengthens the mechanical connection between the acoustic components.

Every component has manufacturing tolerances. The use of molten solder is advantageous over other mechanical fixation methods as it accommodates the manufacture tolerances of materials and of the production process. This is because the capillary effect enables the molten solder to fill in the gaps between the components and enables the parts to move relative to each other for a short period of time, until the solder has hardened due to cooling. This means the loudspeaker can be built in a traditional manner similar to the way in which a loudspeaker is built with glue. This is beneficial as the advantages of the present invention can be implemented without substantial modification of current production lines, thereby reducing costs of producing the present invention.

As an alternative to allowing the solder to cure, for example by allowing it to cool, cooling may be applied to the solder in order to increase the speed of the manufacture process.

At least a portion of the voice coil former and/or the spider and/or the cone may be treated with a surface coating of a material different to that from which it is made, the surface coating is suitable for solder contact.

If at least a portion of one of the acoustic components has a surface coating, the surface coating may be metal wire. The metal wire may be stitched to the acoustical component with the surface coating.

The method may further include the step of pre-tinning a portion of the voice coil former and/or the spider and/or the cone that is to be soldered. This may, for example, include pre-tinning the collar of the spider and/or the collar of the cone.

Flux may be applied to at least part of each of the collar of the cone, the collar of the spider and/or end region of the voice coil former before the cone, spider and voice coil former are assembled into the concentric geometry. Applying the flux before the acoustic components are assembled allows an even coating of flux to be applied. The flux may be applied by painting or dipping the flux onto the surface of the component to which it is being applied.

By "solder" it is meant any conventional solder. However, this may also include any metal or metal alloy that has a melting point lower than that of the components of the loudspeaker, in particular, lower than the acoustic components (the voice coil former, the spider and the cone), but, once melted, is able to maintain a molten form and on cooling sets to form a solid mass. Such a solder must be able to bind to other materials and hold at least two pieces of material together when applied to the materials in a molten state and then allowed to cool. The solder is also required to be able to enter into gaps between materials by capillary action as well as being suitable for the requirements set out herein. Preferably, a solder may have a melting point of at least 160° C. More preferably, a solder may have a melting point between 160° C. and 500° C. Even more preferably, a solder may have a melting point between 180° C. and 450° C. More preferably still, a solder may have a melting point between 200° C. and 400° C. Even more preferably still, a solder may have a melting point between 220° C. and 350° C. Most preferably, a solder may have a melting point between 250° C. and 300° C. Using a solder with a melting point within this range allows the loudspeaker to function at high operating temperatures, such as, for example, 275° C.

Some solders have a range over which they melt known as the melting range. The same limits apply to solders with melting ranges as to solders with melting points.

Solders such as Silver, Silver-Tin alloys or Silver-Lead alloys may be used. Other usable solders may be any one of, or an alloy of two or more of Nickel, Germanium, Phosphorous, Silver, Tin and/or Lead along with other known constituents of solder.

Preferably, the solder used is lead free. This is due to environmental reasons. However, solders containing lead may still be used.

Preferably, a failure temperature of the joint (for example, the melting point) is above the failure temperature of the loudspeaker component with the lowest failure temperature. For loudspeaker components, the failure temperature may be the melting point of a component or a combustion point of a component. This means that when choosing which solder to use the failure temperature of the component with the lowest failure temperature may be considered to allow the solder that is to be used to have a higher melting point.

An embodiment of the invention is described in detail below with reference to the accompanying drawings, in which.

It should be noted that the figures are not drawn to scale.

A first embodiment of the invention is discussed below with reference to FIG. 1A to FIG. 6 and FIG. 8A and FIG. 8B. FIG. 7 shows a part of a second embodiment of the invention. The first embodiment includes a loudspeaker that has the acoustic components (the cone, the spider and the voice coil former) arranged in a concentric geometry with an elongate neck region. The elongate neck region has the ends of the acoustic components drawn together to form a ring of the acoustic components concentrically arranged around each other. Solder is used to hold the parts together to form a mechanical connection between the components. The solder forms a solder joint which is capable of withstanding operating temperatures in an automobile exhaust system.

Other materials may be used to join the acoustic components that would produce the same effect, i.e. by allowing the loudspeaker to function at a high operating temperature. Such materials may be adhesives, but may be other materials that allow a mechanical connection or a glue/adhesive like connection to be formed. For materials that allow a mechanical connection to be formed, this may be done in a similar manner to the use of solder. Alternatively, conventional adhesives/glues may be used as the elongate neck region allows for a stronger joint to be made between the acoustic components as there is improved access to a suitable location to join each of the acoustic components. This will therefore reduce the failure rate in the joint as it will be of a higher quality.

The structure and configuration of the loudspeaker 1 is now discussed with reference to FIGS. 1A to 4.

Figure 1A:
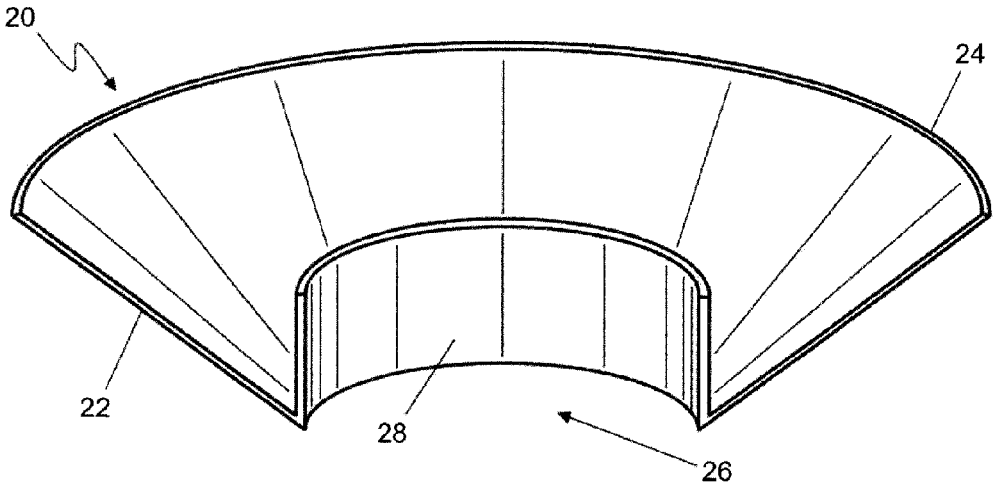
FIG. 1A shows a sectional view of the cone of an embodiment of the invention.

FIG. 1A shows a sectional view of the cone 20 of an embodiment of the invention. The cone is a conventional loudspeaker cone and may be made of paper, plastic, metal or any other material suitable for functioning as a loudspeaker cone. The side 22 of the cone is tapered from a wide top 24 towards a narrow central aperture 26 at a base of the cone. The cone has a collar 28 forming a cylinder that extends around the perimeter of the aperture. The collar is upstanding from the perimeter of the aperture extending from the aperture towards a plane of the top of the loudspeaker. The top 24 of the cone is attachable to a frame (not shown) of the loudspeaker.

Figure 1B:
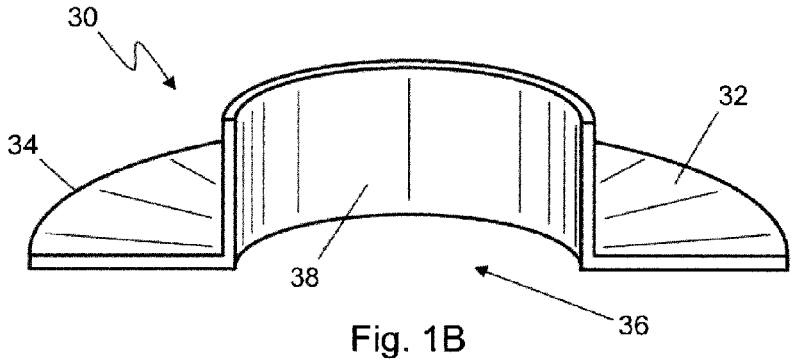
FIG. 1B shows a sectional view of the spider of an embodiment of the invention.

FIG. 1B shows a sectional view of the spider 30 of an embodiment of the invention. The spider is a conventional loudspeaker spider and may be made of any material suitable for functioning as a loudspeaker spider. The spider has a disk 32 which is attachable at an outer edge 34 to a frame (not shown) of the loudspeaker. At the centre of the disk there is an aperture 36 such that at the perimeter of the aperture the disk has an inner edge. The spider has a collar 38 upstanding from the perimeter of the aperture similar to the collar 28 of the cone 38. In the embodiment of the spider shown in FIG. 1B, the disc of the spider is a complete disc with a central aperture. However, the disc can have holes in it in addition to the central aperture as long as it can fulfill its functions of suspending the voice coil former and providing a returning force to an equilibrium position.

Figure 1C:
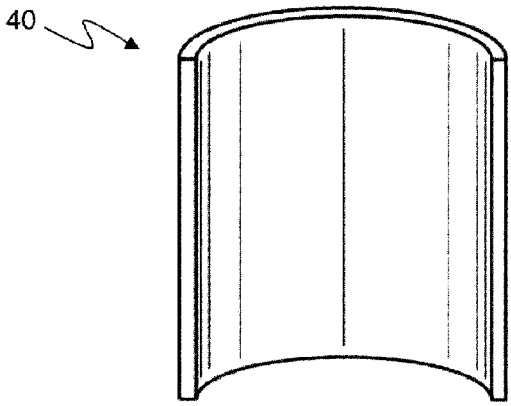
FIG. 1C shows a sectional view of the voice coil former of an embodiment of the invention.

FIG. 1C shows a sectional view of the voice coil former 40 of an embodiment of the invention. The voice coil former is a cylinder which has a coil (not shown) wrapped around a section of the cylinder.

Figure 2:
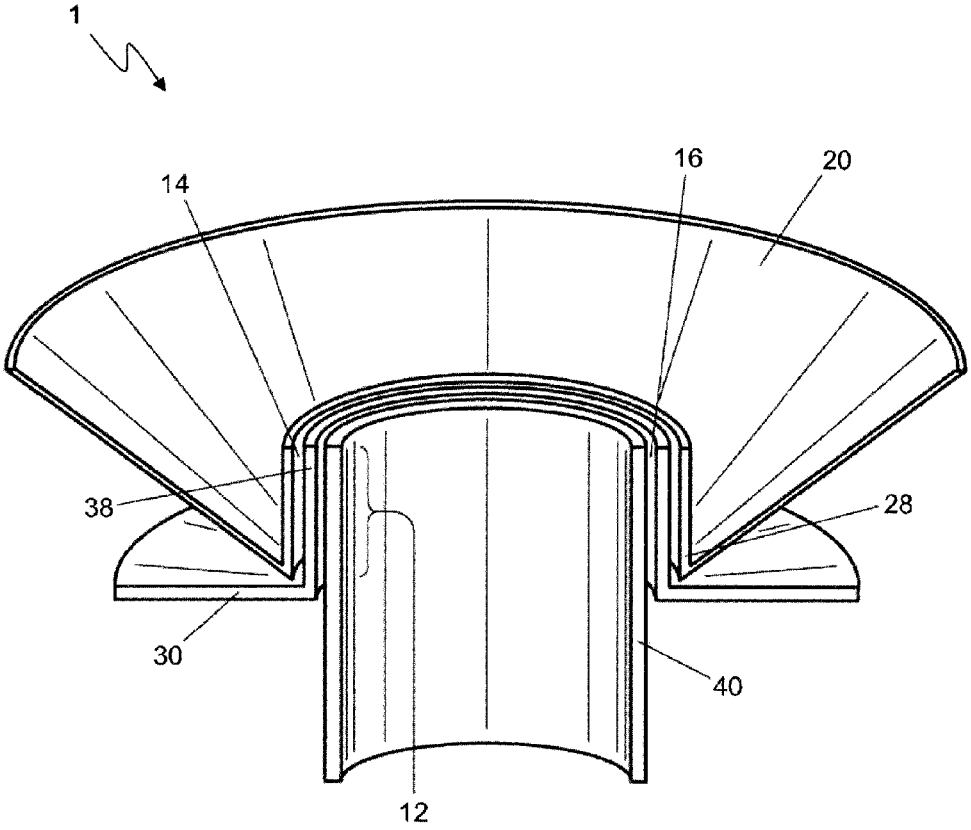
FIG. 2 shows a sectional view of an embodiment of the invention before solder is applied.
Figure 5:
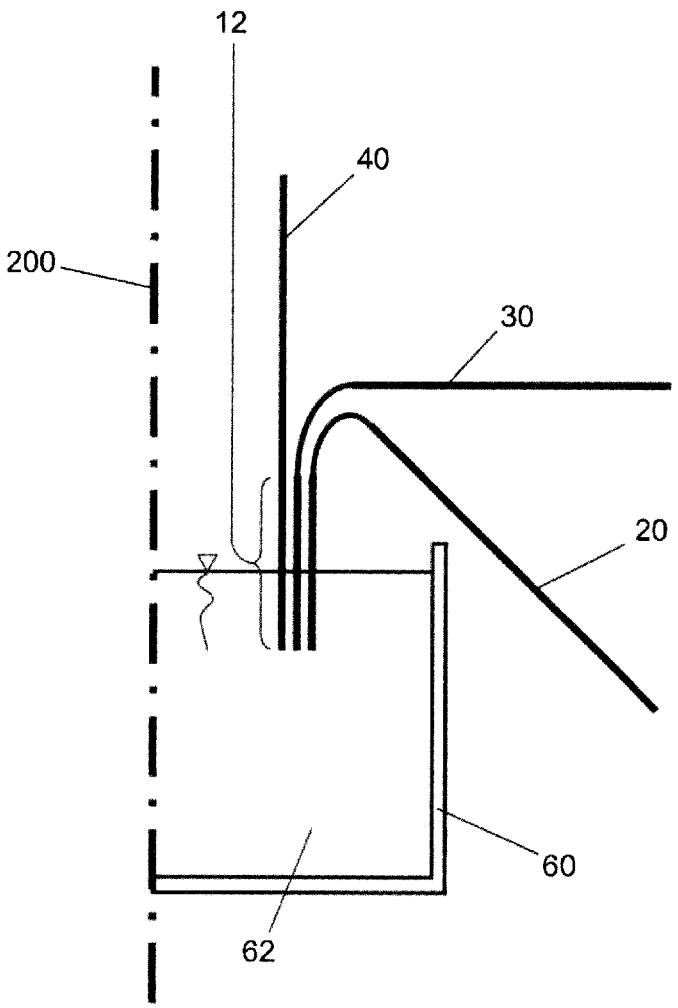
FIG. 5 shows a rotational view of an embodiment of the invention when solder is being applied.
Figure 8A:
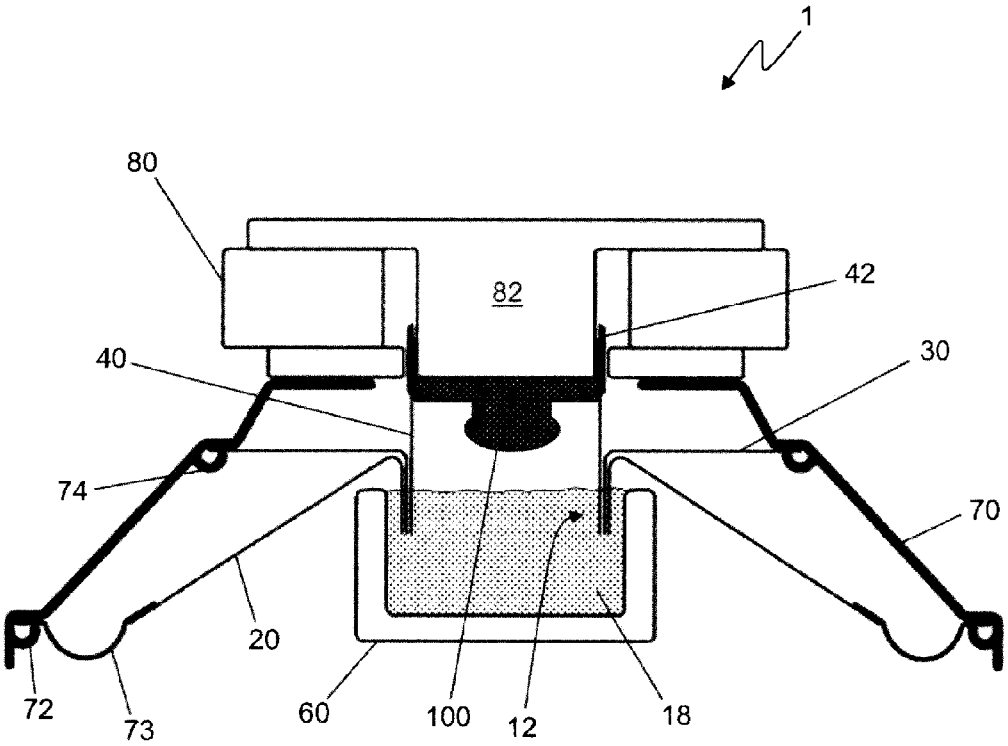
FIG. 8A shows a cross-sectional view of the embodiment of FIG. 7 during the manufacturing process.
Figure 8B:
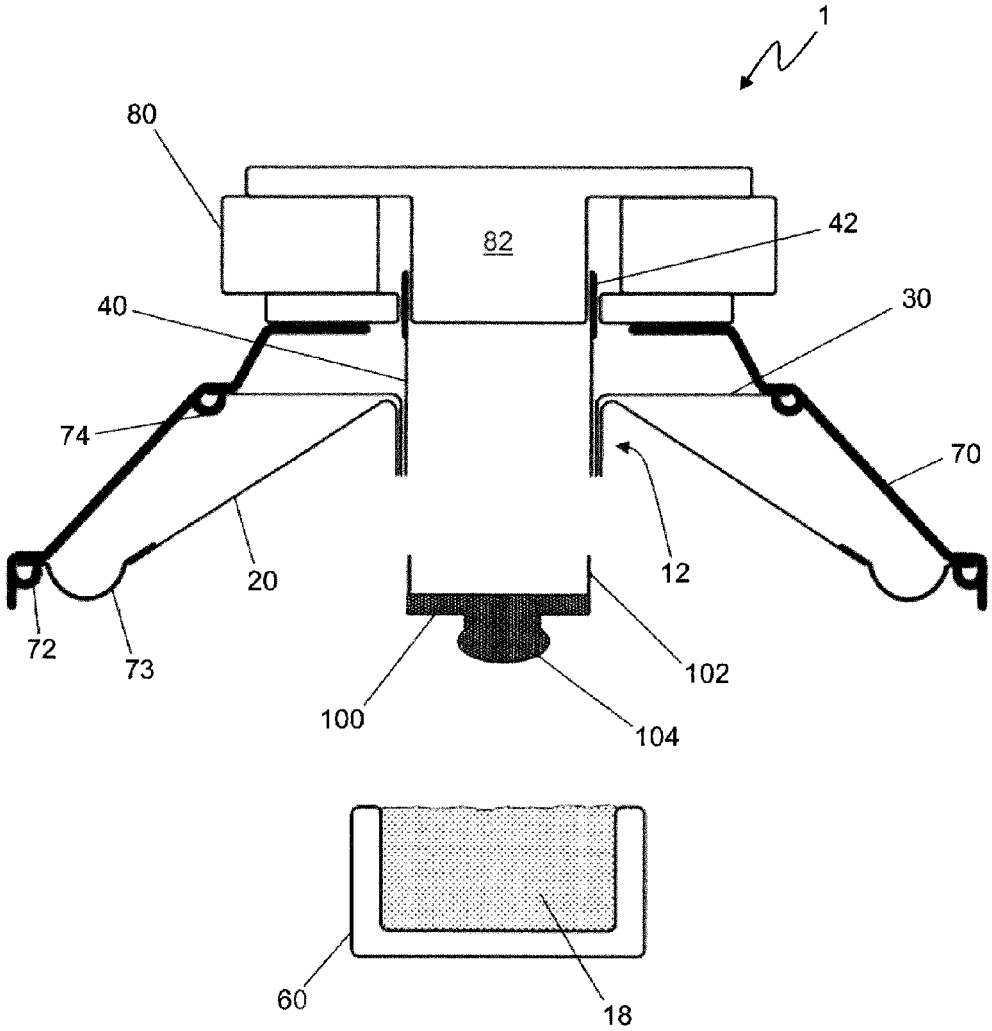
FIG. 8B shows a cross-sectional view of the embodiment of FIG. 7 during a different stage of the manufacturing process.

FIG. 2 shows a sectional view of an embodiment of the invention. The loudspeaker 1 as shown in FIG. 2 has part of the voice coil former 40 fitted inside the collar 38 of the spider 30 which itself is fitted inside the collar 28 of the cone 20. Having the acoustic components fitted over each other forms a region with a concentric geometry. This region is an elongate neck region 12. Due to manufacturing tolerances, the acoustic components are not in contact. It is possible that some or all of the acoustic components may be in contact with each other. When the acoustic components are not in contact, there will be a gap 14 between the collar 28 of the cone and the collar 38 of the spider, and a gap 16 between the collar 38 of the spider and the voice coil former. The concentric geometry of the elongate neck region with the acoustic components fitted around each other allows the elongate neck region to be dipped in a solder bath, as shown in FIG. 5 and FIGS. 8A and 8B, to form a single solder fixing to hold the acoustic components together.

Figure 3:
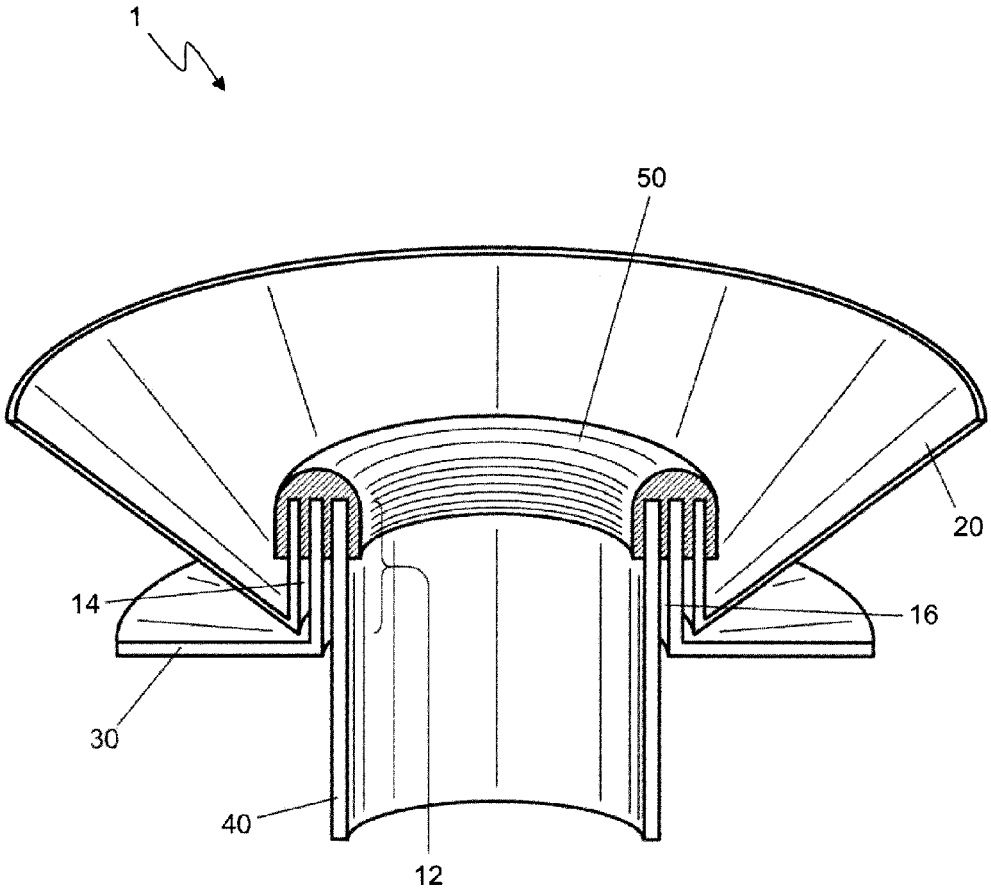
FIG. 3 shows a sectional view of an embodiment of the invention after solder is applied.

FIG. 3 shows the sectional view of the embodiment of the invention shown in FIG. 2 with a solder joint 50 cast around an end portion of the elongate neck region 12. In FIG. 3, the solder forms a ring around the end portion of the elongate neck region to produce a continuous joint that seals the end of the elongate neck region. The solder holds that acoustic components together as it binds to each component thereby forming a fastening between each of the acoustic components by enveloping an end portion of the elongate neck region. When the solder is applied to the loudspeaker, the solder enters the gaps 14 and 16 between the acoustic components. This strengthens the connection to the components themselves and of the overall solder joint as the solder is in contact with, and attached to, a larger surface area of the acoustic components than if it had not entered the gaps.

As can be seen in FIG. 3, the solder joint is the only mechanical connection between the cone, the spider and the voice coil former. This reduces the number of materials and number of parts as well as keeping the production simple thereby keeping costs at a minimum. Having solder as the only mechanical connection between the acoustic components enables the production process to be set up exclusively for the application of solder to the loudspeaker rather than needing additional parts of the production process dedicated to the application of adhesive or joining of the loudspeaker parts.

Figure 4:
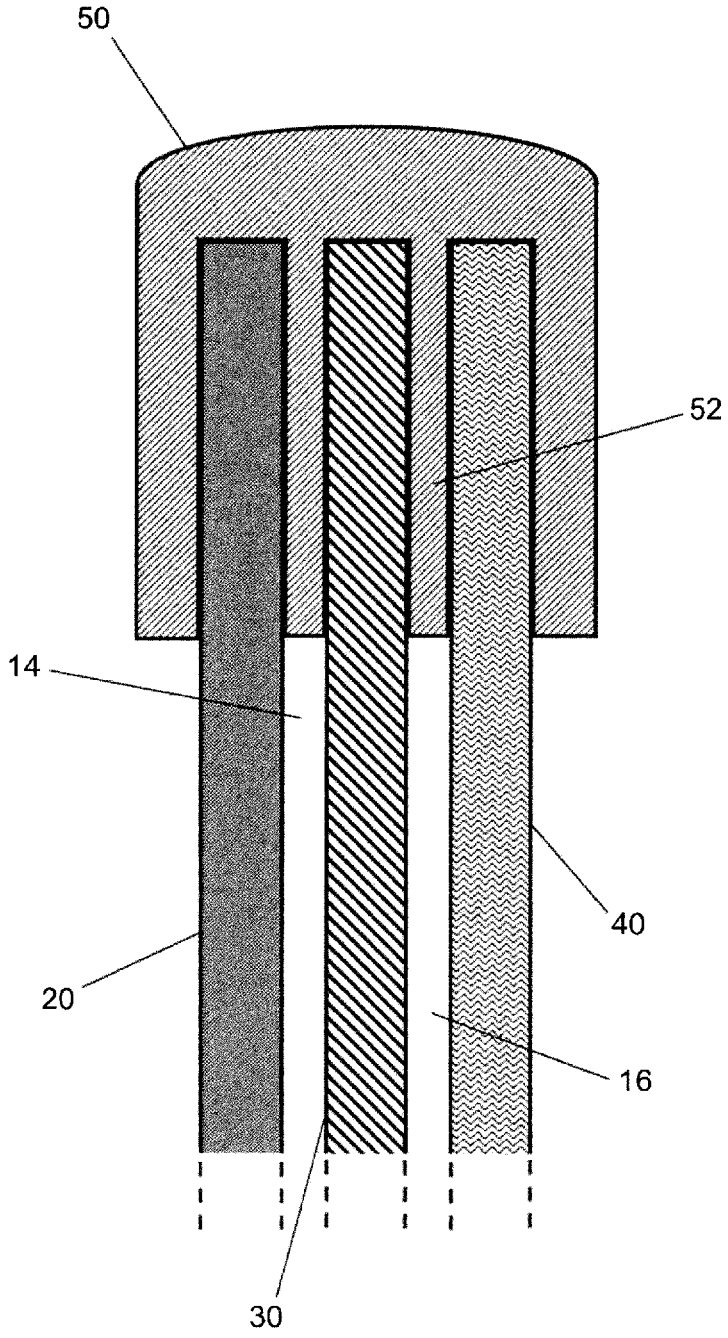
FIG. 4 shows an enlarged cross-sectional view of the solder joint on part of the elongate neck region of an embodiment of the invention.

FIG. 4 shows an enlarged cross-sectional view of the solder joint 50. The joint is formed of solder with a section that covers the ends of the acoustic components and side portions that extend along the sides of the elongate neck region. The solder joint also has filaments 52 that penetrate between the acoustic components in the gaps 14 and 16. This ensures that each of the acoustic components is joined to the solder when the manufacturing tolerances cause there to be gaps between the collar 28 of the cone 20 and the collar 38 of the spider 30 and the voice coil former 40. The filaments are formed by solder being drawn into the gaps by capillary action.

The process of applying the solder to the acoustic components is now discussed with reference to FIG. 5.

FIG. 5 shows a cross-sectional view of the acoustic components 20, 30, 40 of the loudspeaker 1 being dipped in a solder bath 60. The view shown in FIG. 5 may be rotated around axis 200 for to produce a 360° rotation of the section shown in FIG. 5. The solder bath holds molten solder 62. To apply solder to the elongate neck region 12, the elongate neck region is placed partially or fully into the molten solder. This allows solder to envelope the part of the elongate neck region in the molten solder and causes solder to be drawn into the gaps between the acoustic components by capillary action. When the elongate neck region has been in the molten solder for a sufficient period of time it is removed and the solder is allowed to cool naturally or is cooled by a cooling process.

To apply solder to the loudspeaker 1, the acoustic components are assembled to form the concentric geometry of the collar 28 of the cone 20 being fitted around the collar 38 of the spider 30, which, in turn, is fitted around the voice coil former 40. This forms an elongate neck region 12. The elongate neck region protrudes from a central area of the cone proximal to the spider and the central aperture 26 of the cone and extends towards the top 24 of the cone. The shape of the elongate neck region enables the elongate neck region to be dipped in a solder bath 60 of similar dimensions to the elongate neck region without any other part coming into contact with or being dipped in the solder bath. An example of a suitable shape is a cylinder. However, the elongate neck region can be another shape that can be dipped into the solder bath without other parts of the acoustic components or loudspeaker also being dipped into the solder bath.

Once assembled, the elongate neck region is partially of fully dipped in molten solder 62 held in a solder bath 60. The molten solder envelopes the part of the elongate neck region placed in the solder bath. Once in the solder bath, solder can pass into the gaps between the acoustic components. This can either be by flowing between the components if the gaps are large enough to allow the molten solder to flow between the components, or, if the gaps are too small for the molten solder to flow between the components, the molten solder is pulled into the gaps by capillary action.

When the elongate neck region 12 has been in the solder bath 60 for a suitable length of time, it is removed from the solder bath and the solder 62 cools to form a solder joint 50.

The shape of the solder joint is determined by the cooling of the solder and any surface tension effects that may occur. The shape applied to the solder joint in FIG. 3 and FIG. 4 is only illustrative and should not be taken as a limitation on the shape of the solder joint.

Depending on the needs of the design and processes required of the loudspeaker, the solder joint may be shaped into an alternative geometry to suit the needs of loudspeaker. For a solder joint to effectively join the acoustic components, each acoustic component needs to be solderable in some way. By solderable we mean that solder can be applied to and then stick to a material once the solder cools. Solderable materials are usually metal. Due to this, the acoustic components of the loudspeaker 1 may be metal, such as, for example, brass, aluminium or copper. However, materials are preferably low density and are non-magnetic, so a number of other materials would be suitable.

The material that each acoustic component is made of is limited by its own properties, such as how flexible the material is of how much tension can be applied to the material. This there has an effect on the working of each acoustic component. For example, loudspeaker cones are often made from paper. It is also common for loudspeaker spiders to be made of fabric or to be fabric based. As may be readily understood, such materials are unlikely to be solderable. When an acoustic component is made of non-solderable material there are a number of solutions that enable solder to be applied to the non-solderable component so that it may be joined to the other acoustic components. The non-solderable part can be treated with a surface that improves the solder contact. Additionally, metal wires can be stitched to the materials, thus improving materials ability for solder to join to it.

To aid the soldering process, the parts of the elongate neck region (part of the collar 28 of the cone 20, part of the collar 38 of the spider 30 and part of the voice coil former 40) to which solder is to be applied to can be pre-tinned with solder. This allows solder to bind to each of the acoustic components more easily as the molten solder binds to the pre-tinned solder more easily than to the material. Pre-tinning also enhances the capillary effect of solder entering between the acoustic components. Pre-tinning is well known in the field of electronics for improving the durability strength and quality of solder joints between components.

Figure 6:
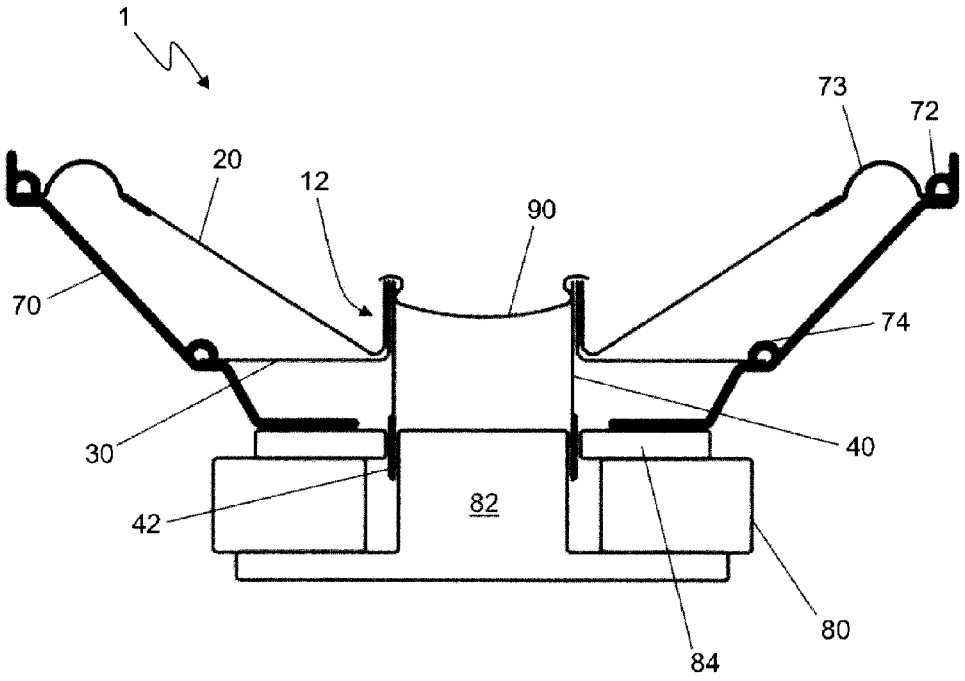
FIG. 6 shows a cross-sectional view of another embodiment of the invention.
Figure 7:
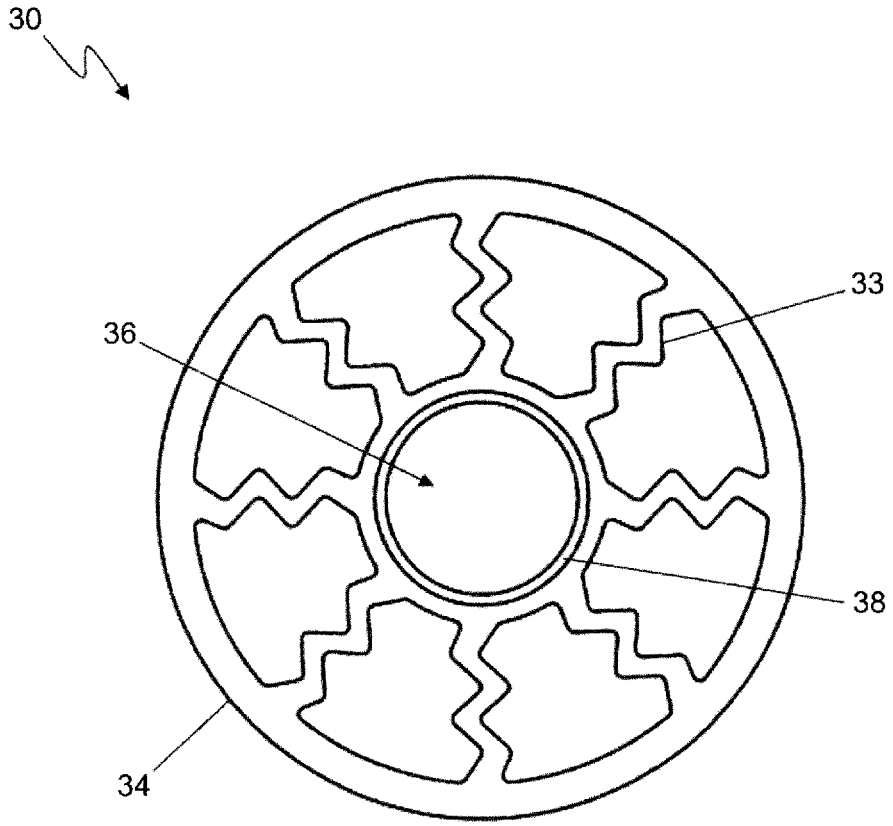
FIG. 7 shows a plan view of a spider of another embodiment of the invention.

The structure of the loudspeaker including the frame and driving parts is now discussed in relation to FIG. 6.

FIG. 6 shows a cross-sectional view of an embodiment of the loudspeaker 1 showing the acoustic components of the loudspeaker (cone 20, spider 30, voice coil former 40) fitted to the frame 70 and magnet system 80. The magnetic system has a central part 82 that forms a back of the loudspeaker from which a column extents towards the top 24 of the cone. An outer part 84 of the magnetic system is located around at an end of the column distal to the back of the loudspeaker. The outer part forms a ring around the end of the column and is made up of either a single piece or of multiple pieces. There is a gap between the outer part and the column in which the voice coil former and voice coil 42 are fitted. The frame of the loudspeaker sits on the outer part of the magnetic system on a side of the outer part distal to the back of the loudspeaker. The frame is attached to the magnetic system by a fixing means.

As shown in FIG. 6, the voice coil former 40 has the voice coil 42 fitted to one end of the voice coil former. The voice coil former is suspended by the spider 30 which holds the voice coil in the gap between the column of the central part 82 and the outer part 84 of the magnetic system. This suspends the voice coil in the magnetic field of the magnetic system 80. To work effectively there is not contact between the voice coil and the magnetic system. However, the loudspeaker 1 will only function when the voice coil is in the magnetic field of the magnetic system. To spider is sufficiently resilient to hold the voice coil in the magnetic field of the magnetic field system by withstanding the forces that are generated when a current is passed through the voice coil. The spider also suspends the voice coil former and stops it form coming into contact with any other part of the loudspeaker when it is oscillating, or from touching any part of the loudspeaker when it is not oscillating.

FIG. 6 shows the attachment of the cone 20 to the frame 70 by a first mechanical clamp 72. To ensure the connection between the cone and frame is flexible whilst being securely connected to the frame, there is an edge section 73 which is attached to the cone at an internal end of the edge section and held by the first mechanical clamp at the outer end of the edge section. The first mechanical clamp is a folded or curled section of the frame that holds the edge section by pressing the edge section against the body of the frame. The edge section is made of a material suitable for flexing to account for the oscillations of the cone. The material for the edge section may, for example, be temperature resistive rubber, woven fabric or woven metal.

When the edge section is made of temperature resistive rubber, woven fabric or woven metal, it may be attached to the cone by stitching. Alternatively the edge section and the cone may be joined by integration of the edge section. This can be done by forming the cone and the edge of a single piece of material or by forming the join between the edge and cone by a moulding technique, the outer circumference of the edge and cone formed into a single geometry can then be mechanically connected directly to the frame.

It would also be possible to make the edge and cone from a single piece of Teflon (i.e. Polytetrafluoroethylene, or PTFE) as this is mouldable, which would enable the cone and edge to be given their desired shape whilst being able to be formed of one piece. Using Teflon, it would also be possible to insert-mould the edge and cone in a single piece. This would reduce manufacture time and costs and would enable efficient mass production of the edge and cone.

By using insert moulding, elements of solderable material could be added to the moulding process causing them to be embedded in the Teflon and present in the final moulded form. This can be done either by putting the elements in the mould before the Teflon is introduced to the mould, or be incorporating the Teflon and the elements together before or on entry to the mould.

The solderable elements, such as for example, solderable metal filings, thereby make it easier to solder to the Teflon and for solder to bind to the Teflon. This is because, due to the embedding, a number of the elements will be located at or on the surface of the Teflon and will therefore be exposed. There may also be a number of the elements held within the Teflon not exposed to the surface. However, this will be dependent on the technique used to embed the elements in the Teflon.

When using a Teflon cone, the loudspeaker may, for example, be able to operate at a temperature of 275° C. without the components or the joint between the components failing. It is also possible for the loudspeaker to operate at such a temperature when Teflon is not used for the cone or any other part of the loudspeaker.

In FIG. 6 the spider 30 is attached to the frame by a second mechanical clamp 74. There is no need for an edge section to be attached to the spider, as, due to its function of retaining the voice coil former and returning it to an equilibrium position when the voice coil former moves, it can deform when the voice coil moves and so no edge section is needed to account for movement of the speaker. In an alternative attachment means to the mechanical clamp, the spider may be stitched to the frame.

The embodiment of the invention shown in FIG. 6 has a dust cap 90 that is fitted over an end of the elongate neck region. The dust cap is held to the elongate neck region by a mechanical clamp.

The dust cap stops dust, particles and other matter from getting into the voice coil former and entering the magnetic system.

FIG. 7 shows a metallic spider of an embodiment of the invention. For a loudspeaker designed to work at high temperatures, a designer may want to use all metal components for the acoustic components. The metal spider shown in FIG. 7 has the features of the spider such as the outer edge 34, the central aperture 36 and the collar 38. However, instead of the disk 32 (as shown in, for example, FIG. 1A) the metal spider has resiliently deformable spokes 33. The spokes have a shape that enables them to deform to allow the collar of the spider to move above or below a plane of the spider. The spokes act as springs to return the collar and anything that it may be attached to its initial position. The spokes 33 of the embodiment shown in FIG. 7 are a zig-zag shape that are concertinaed in an equilibrium or starting position and extend to allow the collar to move. The spokes are evenly distributed around the spider to ensure movement is only along an axis perpendicular to the plane of the spider. If there is movement that is not perpendicular to the plane of the spider, such movement is likely to cause wear or damage the loudspeaker 1.

In an active sound control system in an exhaust system a loudspeaker may have acoustic components only made of metal. A loudspeaker in such an active sound control system may only be required to work in pistonic modes, and therefore at low frequencies. At low frequencies the geometry of the speaker may be changed from that of a conventional loudspeaker to allow the elongated neck construction of the loudspeaker 1 to be used. However, loudspeakers with such a geometry can be applied to all types of loudspeakers, such as, for example, mid-range, full-range, woofer or sub-woofer loudspeakers.

FIG. 8A shows a cross-section of an embodiment of the invention during the application of solder 18 to the elongate neck portion 12. To retain the voice coil former 40 in a position where the voice coil 42 is not in contact with the magnetic system 80 or any other part of the loudspeaker 1, before the elongate neck region is dipped in the solder bath 60, a centring jig 100 is placed inside the voice coil former. The centring jig is sized to cooperatively fit inside the voice coil former. The jig can be slid into the voice coil former and pushed against the magnetic system 80. In this position, the legs 102 of the jig fit between the magnetic system and the voice coil former to create a gap around the central part 82 of the magnetic system. To ensure there is a gap around the entire diameter of the voice coil former, the legs of the jig extend around the diameter of the jig. The jig may have multiple legs or one single leg that protrudes from the edge of the jig. The jig also has a handle 104. The handle allows the jig to be placed in the voice coil former and removed.

FIG. 8B shows a cross-section of the same embodiment shown in FIG. 8A showing each of the parts separately. FIG. 8B shows the jig 100 with the legs 102 and handle 104 separated from the loudspeaker 1.

FIG. 8A shows the loudspeaker during the application of molten solder and FIG. 8B shows the loudspeaker after the application of molten solder to the elongate neck region. The centring jig 100 is removed from the centre of the loudspeaker after curing. The jig is used to maintain the alignment of the voice coil former 40 and the magnetic system 80 when the solder is curing. After the centring jig is removed, the dust cap is placed over the gap, from which the jig is removed, to protect the air gap between the voice coil former and the magnetic system. This prevents any unwanted particles from entering the air gap. This is done as the air gap is sufficiently narrow that it could easily be clogged by particles and disable the cone movement.

The invention claimed is:

1. A loudspeaker including:

a cone having a central aperture at a base of the cone, wherein a side of the cone is tapered from a wide top towards the central aperture at the base of the cone, the cone having a cone collar that is upstanding from the perimeter of the central aperture of the cone and that extends towards the wide top of the cone;

a spider having a central aperture, the spider having a collar upstanding from the perimeter of the central aperture of the spider; and a voice coil former, wherein the collar of each of the cone and the spider is concentrically located around an end region of the voice coil former to form an elongate neck region wherein the end region of the voice coil former is fitted inside the collar of the spider and the collar of the spider is fitted inside the collar of the cone.

2. A loudspeaker according to claim 1, wherein the spider and the cone are mechanically connected to the voice coil former by a solder joint, the solder being configured to maintain a mechanical connection at an operating temperature up to the melting point of the solder.

3. A loudspeaker according to claim 2, wherein the elongated neck region has a solder joint that mechanically connects the cone to the spider and the voice coil former.

4. A loudspeaker according to claim 2, wherein at least a portion of the voice coil former and/or the spider and/or the cone have a surface coating of a material different to that from which it is made, wherein the surface coating is suitable for solder contact, wherein the surface coating is metal wire that is stitched to the voice coil former and/or the spider and/or the cone.

5. A loudspeaker according to claim 1, wherein the voice coil former and/or the spider and/or the cone are made of metal.

6. A loudspeaker according to claim 1, wherein the cone is made of Teflon.

7. A loudspeaker according to claim 6, wherein the voice coil former and/or the spider is made of metal.

8. A loudspeaker according to claim 2, wherein the solder has a melting point of at least 160° C.

9. A loudspeaker according to claim 2, wherein the solder has a melting point of between 250° and 300°.

10. A method of constructing a loudspeaker, comprising the step: assembling a cone, a spider and a voice coil former into a concentric geometry by fitting a collar of the cone and a collar of the spider around an end region of the voice coil former to form an elongate neck region, the cone collar being upstanding from the perimeter of a central aperture at a base of the cone, the cone collar extending towards a wide top of the cone, wherein a side of the cone is tapered from the wide top towards the central aperture at the base of the cone, and the spider collar being upstanding from the perimeter of a central aperture of the spider wherein the end region of the voice coil former is fitted inside the collar of the spider and the collar of the spider is fitted inside the collar of the cone.

11. A method according to claim 10, wherein solder is used to mechanically connect the voice coil former, the spider and the cone of the loudspeaker, and wherein the solder maintains a mechanical connection at an operating temperature up to the melting point of the solder.

12. A method according to claim 11, wherein to apply solder, the method further comprises the steps:

dipping the elongate neck region in a solder bath of molten solder;

removing the elongate neck region from the solder bath of molten solder, wherein solder adhering to the elongate neck region is set by allowing the solder to cure, thereby forming the solder joint between the cone, spider and voice coil former as a mechanical connection.

13. A method according to claim 11, the method further including the step of treating at least a portion of the voice coil former and/or the spider and/or the cone with a surface coating of a material different to that from which it is made, wherein the surface coating is suitable for solder contact, wherein the surface coating is metal wire.

14. A method according to claim 13, wherein the metal wire is stitched to the portion of the voice coil former and/or the spider and/or the cone.

15. A method according to claim 11, further including the step of pre-tinning at least a portion of the voice coil former and/or the spider and/or the cone with solder.

16. A method according to claim 11, wherein flux is applied to at least part of each of the collar of the cone, the collar of the spider and/or end region of the voice coil former before the cone, spider and voice coil former are assembled into the concentric geometry.

17. A method according to claim 11, wherein the solder has a melting point of 160° C.

18. A method according to claim 11, wherein the solder has a melting point between 180° C. and 450° C.

19. A method according to claim 11, wherein the solder has a melting point between 220° C. and 350° C.

20. A method according to claim 11, wherein the solder has a melting point between 250° C. and 300° C.

21. A loudspeaker according to claim 3, wherein the solder joint is a single continuous solder joint that is enveloped around an end portion of the elongate neck region to form a ring of solder around the end portion of the elongate neck region.

* * * * *